US009800971B2

(12) United States Patent
Manley et al.

(10) Patent No.: US 9,800,971 B2
(45) Date of Patent: Oct. 24, 2017

(54) ACOUSTIC APPARATUS WITH SIDE PORT

(71) Applicant: Knowles Electronics, LLC, Itasca, IL (US)

(72) Inventors: Matthew Manley, Crystal Lake, IL (US); John Rodack, Lockport, IL (US)

(73) Assignee: Knowles Electronics, LLC, Itasca, IL (US)

( * ) Notice: Subject to any disclaimer, the term of this patent is extended or adjusted under 35 U.S.C. 154(b) by 0 days.

(21) Appl. No.: 15/064,277

(22) Filed: Mar. 8, 2016

(65) Prior Publication Data

US 2016/0277831 A1 Sep. 22, 2016

Related U.S. Application Data

(60) Provisional application No. 62/134,124, filed on Mar. 17, 2015.

(51) Int. Cl.

| | |
|---|---|
| ***H04R 19/04*** | (2006.01) |
| ***H04R 1/34*** | (2006.01) |
| ***H04R 19/00*** | (2006.01) |
| *H04R 1/04* | (2006.01) |

(52) U.S. Cl.

CPC ..... *H04R 1/342* (2013.01); *H04R 19/005* (2013.01); *H04R 19/04* (2013.01); *H04R 1/04* (2013.01); *H04R 2201/003* (2013.01); *H04R 2499/11* (2013.01)

(58) Field of Classification Search

CPC ..... H04R 1/04; H04R 1/342; H04R 19/005; H04R 19/016; H04R 19/04; H04R 23/006; H04R 2201/003; H04R 2499/01; B81B 7/0061

USPC ..... 381/113, 116, 173, 174, 175, 369, 191, 381/355, 356, 360, 365; 367/170, 181; 19/25.41, 25.42; 29/25.41, 25.42

See application file for complete search history.

(56) References Cited

U.S. PATENT DOCUMENTS

| | | | |
|---|---|---|---|
| 5,740,261 | A | 4/1998 | Loeppert |
| 6,552,469 | B1 | 4/2003 | Pederson |
| 6,781,231 | B2 | 8/2004 | Minervini |
| 7,166,910 | B2 | 1/2007 | Minervini |
| 7,190,038 | B2 | 3/2007 | Dehe |
| 7,242,089 | B2 | 7/2007 | Minervini |
| 7,382,048 | B2 | 6/2008 | Minervini |
| 7,439,616 | B2 | 10/2008 | Minervini |

(Continued)

FOREIGN PATENT DOCUMENTS

| | | |
|---|---|---|
| DE | 112010006098 | 3/2014 |
| EP | 1346601 | 5/2011 |

*Primary Examiner* — Huyen D Le

(74) *Attorney, Agent, or Firm* — Faegre Baker Daniels LLP

(57) ABSTRACT

An apparatus includes a microphone and a gasket. The microphone includes a base having an inner surface and an outer surface. The inner surface is generally parallel with the outer surface. The base has a port extending from the outer surface to the inner surface. The microphone includes a micro electro mechanical system (MEMS) transducer coupled to the inner surface of the base over the port. The microphone has a cover coupled to the base and the cover encloses the MEMS transducer. The gasket is coupled to the outer surface of the base and forms a channel. The channel has a first end and a second end. The first end communicates with the port of the microphone, and the second end of the channel is generally aligned with an edge of the base.

20 Claims, 4 Drawing Sheets

(56) References Cited

U.S. PATENT DOCUMENTS

| | | | | |
|---|---|---|---|---|
| 7,466,834 | B2 * | 12/2008 | Ogura | B81B 7/0061 381/174 |
| 7,473,572 | B2 | 1/2009 | Dehe | |
| 7,501,703 | B2 | 3/2009 | Minervini | |
| 7,633,156 | B2 | 12/2009 | Minervini | |
| 7,781,249 | B2 | 8/2010 | Laming | |
| 7,795,695 | B2 | 9/2010 | Weigold | |
| 7,825,484 | B2 | 11/2010 | Martin | |
| 7,829,961 | B2 | 11/2010 | Hsiao | |
| 7,856,804 | B2 | 12/2010 | Laming | |
| 7,903,831 | B2 | 3/2011 | Song | |
| 8,018,049 | B2 | 9/2011 | Minervini | |
| 8,121,331 | B2 | 2/2012 | Minervini | |
| 8,170,244 | B2 | 5/2012 | Ryan | |
| 8,358,004 | B2 | 1/2013 | Minervini | |
| 8,450,817 | B2 | 5/2013 | Minervini | |
| 8,526,665 | B2 | 9/2013 | Lutz | |
| 8,594,347 | B2 | 11/2013 | Ryan | |
| 8,624,384 | B1 | 1/2014 | Minervini | |
| 8,624,385 | B1 | 1/2014 | Minervini | |
| 8,624,386 | B1 | 1/2014 | Minervini | |
| 8,624,387 | B1 | 1/2014 | Minervini | |
| 8,629,551 | B1 | 1/2014 | Minervini | |
| 8,629,552 | B1 | 1/2014 | Minervini | |
| 8,704,360 | B1 | 4/2014 | Minervini | |
| 8,781,140 | B2 | 7/2014 | Lautenschlager | |
| 8,791,531 | B2 | 7/2014 | Loeppert | |
| 8,879,767 | B2 | 11/2014 | Wickstrom | |
| 8,969,980 | B2 | 3/2015 | Lee | |
| 8,983,105 | B2 | 3/2015 | Reining | |
| 8,995,694 | B2 | 3/2015 | Vos | |
| 9,006,880 | B1 | 4/2015 | Minervini | |
| 9,023,689 | B1 | 5/2015 | Minervini | |
| 9,024,432 | B1 | 5/2015 | Minervini | |
| 9,051,171 | B1 | 6/2015 | Minervini | |
| 9,078,063 | B2 | 7/2015 | Loeppert | |
| 9,137,595 | B2 | 9/2015 | Lee | |
| 9,139,421 | B1 | 9/2015 | Minervini | |
| 9,139,422 | B1 | 9/2015 | Minervini | |
| 9,148,731 | B1 | 9/2015 | Minervini | |
| 9,338,560 | B1 | 5/2016 | Minervini | |
| 2005/0207605 | A1 | 9/2005 | Dehe | |
| 2007/0215962 | A1 | 9/2007 | Minervini | |
| 2007/0278501 | A1 | 12/2007 | MacPherson | |
| 2007/0278601 | A1 | 12/2007 | Goodelle | |
| 2008/0175425 | A1 | 7/2008 | Roberts | |
| 2008/0217709 | A1 | 9/2008 | Minervini | |
| 2008/0267431 | A1 | 10/2008 | Leidl | |
| 2008/0279407 | A1 | 11/2008 | Pahl | |
| 2008/0283942 | A1 | 11/2008 | Huang | |
| 2009/0001553 | A1 | 1/2009 | Pahl | |
| 2009/0180655 | A1 | 7/2009 | Tien | |
| 2010/0046780 | A1 | 2/2010 | Song | |
| 2010/0052082 | A1 | 3/2010 | Lee | |
| 2010/0128914 | A1 | 5/2010 | Khenkin | |
| 2010/0183181 | A1 | 7/2010 | Wang | |
| 2010/0246877 | A1 | 9/2010 | Wang | |
| 2010/0290644 | A1 | 11/2010 | Wu | |
| 2010/0322443 | A1 | 12/2010 | Wu | |
| 2010/0322451 | A1 | 12/2010 | Wu | |
| 2011/0013787 | A1 | 1/2011 | Chang | |
| 2011/0075875 | A1 | 3/2011 | Wu | |
| 2012/0039499 | A1 | 2/2012 | Ryan | |
| 2013/0108074 | A1 | 5/2013 | Reining | |
| 2013/0177192 | A1 | 7/2013 | Abry | |
| 2014/0037115 | A1 | 2/2014 | Vos | |
| 2014/0037120 | A1 | 2/2014 | Lim | |
| 2014/0037124 | A1 | 2/2014 | Lim | |
| 2014/0064546 | A1 | 3/2014 | Szczech | |
| 2014/0133686 | A1 | 5/2014 | Lee | |
| 2014/0169607 | A1 * | 6/2014 | Goida | H04R 1/021 381/365 |
| 2014/0291783 | A1 | 10/2014 | Talag | |
| 2014/0291784 | A1 | 10/2014 | Conklin | |
| 2014/0294209 | A1 | 10/2014 | Szczech | |
| 2014/0321687 | A1 | 10/2014 | Friel | |
| 2015/0041931 | A1 | 2/2015 | Szczech | |
| 2015/0117681 | A1 | 4/2015 | Watson | |
| 2015/0139428 | A1 | 5/2015 | Reining | |
| 2015/0172825 | A1 | 6/2015 | Lim | |
| 2015/0175659 | A1 | 6/2015 | Gualtieri | |
| 2015/0208165 | A1 | 7/2015 | Volk | |
| 2015/0251898 | A1 | 9/2015 | Vos | |
| 2016/0071506 | A1 | 3/2016 | Qutub | |
| 2016/0100257 | A1 | 4/2016 | Nielsen | |

* cited by examiner

ACOUSTIC APPARATUS WITH SIDE PORT

CROSS-REFERENCE TO RELATED APPLICATION

This patent claims benefit under 35 U.S.C. §119(e) to U.S. Provisional Application No. 62/134,124 entitled "Acoustic Apparatus with Side Port" filed Mar. 17, 2015, the content of which is incorporated herein by reference in its entirety.

TECHNICAL FIELD

This application relates to acoustic devices and, more specifically, to the configuration of these devices and their disposition with consumer devices.

BACKGROUND

Different types of acoustic devices have been used through the years. One type of device is a microphone and one type of microphone is a microelectromechanical system (MEMS) microphone. A MEMS microphone includes a MEMS die having at least one diaphragm and at least one back plate. The MEMS die is sometimes disposed on a substrate or base, and enclosed by a housing (e.g., a cup or cover with walls). A port may extend through the substrate (for a bottom port device) or through the top of the housing (for a top port device). In any case, sound energy traverses through the port, moves the diaphragm and creates a changing potential of the back plate, which creates an electrical signal. The electrical signal can be further processed by devices such as application specific integrated circuits (ASICs).

Microphones are mounted or disposed in various types of devices such as personal computers, tablets, and hearing aids to mention a few examples. As mentioned, a port is disposed in the microphone, often times through the base. Another second port is present in the device in which the microphone is disposed and this other port allows sound to pass through the second port to the microphone inside the device.

However, this placement of the microphone port is sometimes inconvenient with respect to the configuration of the device in which the microphone is located. For example, the microphone port at the base may not align with the second port or opening in the customer device. This misalignment sometimes requires the design of the device to be adjusted or modified, which increases the overall cost and complexity of the resultant system. These problems have resulted in some user dissatisfaction with previous approaches.

BRIEF DESCRIPTION OF THE DRAWINGS

For a more complete understanding of the disclosure, reference should be made to the following detailed description and accompanying drawings wherein.

Figure 1:
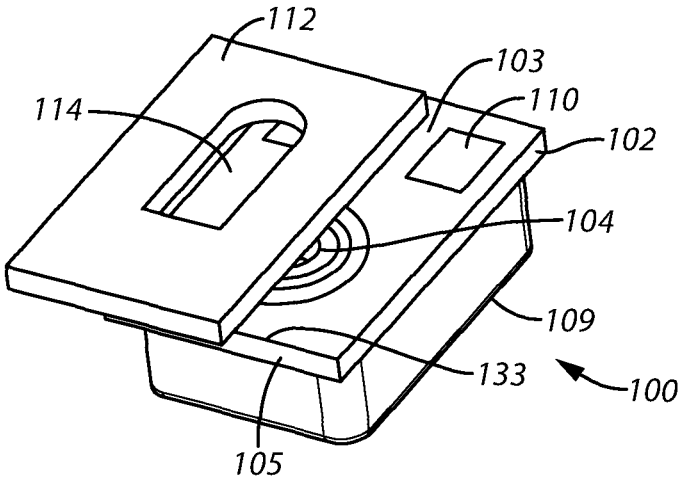
FIG. 1 comprises a perspective view an acoustic apparatus with the gasket in an unbent position according to various embodiments of the present invention.
Figure 2:
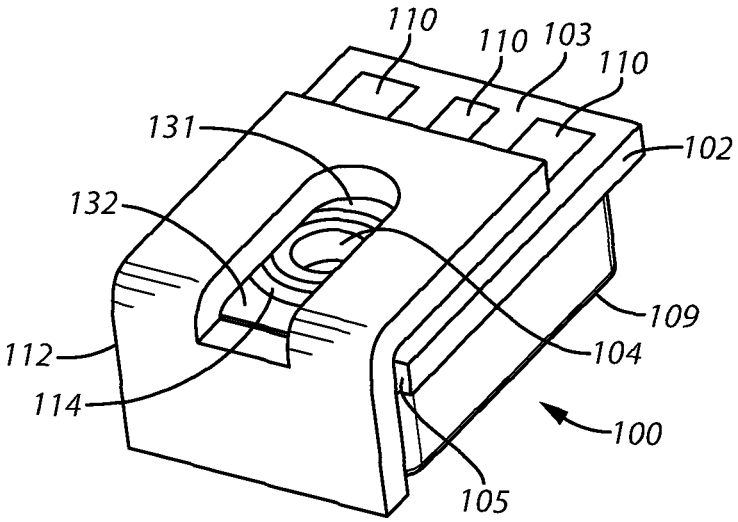
FIG. 2 comprises a perspective view of the acoustic apparatus of FIG. 1 with the gasket bent or folded according to various embodiments of the present invention.
Figure 3:
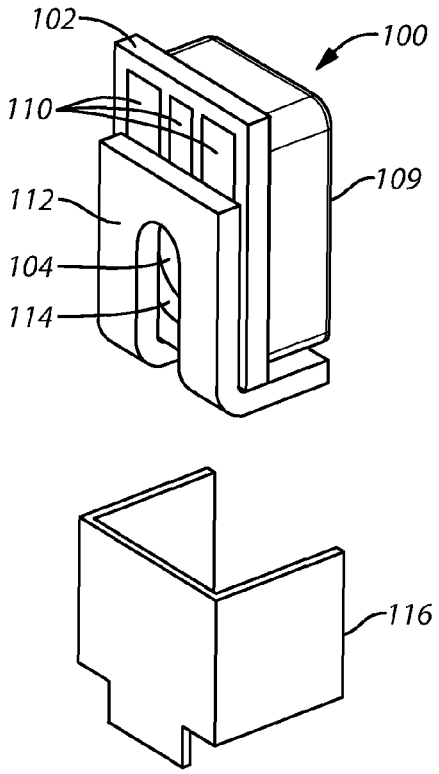
FIG. 3 comprises a perspective view of the acoustic apparatus of FIG. 1 and FIG. 2 with the gasket bent or folded and showing the face plate according to various embodiments of the present invention.
Figure 4:
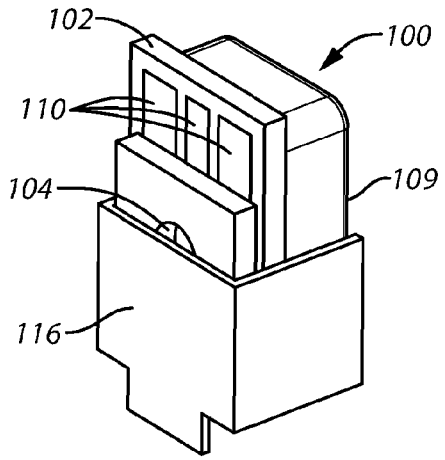
FIG. 4 comprises a perspective view of the acoustic apparatus of FIG. 1, FIG. 2, and FIG. 3 with the gasket bent or folded and showing the face plate according to various embodiments of the present invention.
Figure 5:
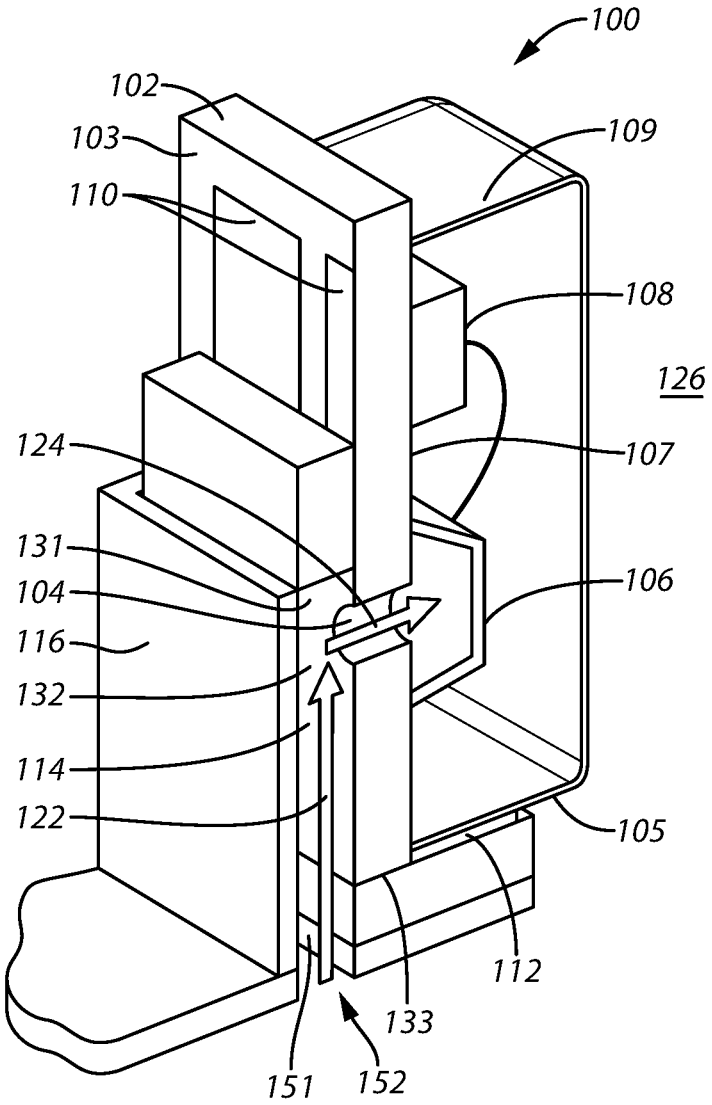
FIG. 5 comprises a side cutaway view of the acoustic apparatus of FIG. 1, FIG. 2, FIG. 3, and FIG. 4 disposed in a customer device according to various embodiments of the present invention.

Skilled artisans will appreciate that elements in the figures are illustrated for simplicity and clarity. It will further be appreciated that certain actions and/or steps may be described or depicted in a particular order of occurrence while those skilled in the art will understand that such specificity with respect to sequence is not actually required. It will also be understood that the terms and expressions used herein have the ordinary meaning as is accorded to such terms and expressions with respect to their corresponding respective areas of inquiry and study except where specific meanings have otherwise been set forth herein.

DETAILED DESCRIPTION

In the present approaches, a gasket is adhered to a microphone and in some examples is wrapped around one of the ends of the microphone, where the microphone is disposed within another device. A face plate (or similar structure) is disposed against the gasket. An opening in the gasket creates an acoustic path or passageway between the face plate and the microphone. In some aspects, the microphone seals around the port so that manually dispensing a sealant all around the body of the microphone is not necessary.

It will be appreciated that the structures provided herein effective create and result in a side port microphone where sound energy enters from the side of the microphone and is directed to a port in the microphone. Consequently, the disposition of the microphone is a device (e.g., hearing aid, personal computer, tablet, cellular phone) can be much more flexible than in previous approaches where the microphone had to be arranged to take into account the configuration of the host device and the arrangement of components within the host device.

In many of these embodiments, an acoustic apparatus includes a microphone. The microphone includes a MEMS device that is disposed on a base or substrate. A port extends through the base or substrate and the MEMS device is disposed over the port. A cover encloses the MEMS device. A gasket (which may be constructed of a flexible material) includes a channel and may extend around portions of the substrate. A face plate or other structure extends around portions of the gasket and channel. The channel extends parallel to the bottom surface of the base and across a length of the base. The face plate compresses or covers the gasket. Sound energy enters the channel, traverses the channel along the base, and enters the port. The sound energy must traverse the channel before entering the microphone and consequently does not directly enter the microphone from the exterior of the device in a direction perpendicular to the bottom surface of the microphone.

In other aspects, an apparatus includes a microphone and a gasket. The microphone includes a base having an inner surface and an outer surface. The inner surface is generally parallel with the outer surface. The base has a port extending from the outer surface to the inner surface. The microphone includes a MEMS transducer coupled to the inner surface of the base over the port. The microphone has a cover coupled to the base and encloses the MEMS transducer. The gasket is coupled to the outer surface of the base and forms a channel. The channel has a first end and a second end. The first end communicates with the port of the microphone, and the second end of the channel is generally aligned with an edge of the base.

Referring now to FIGS. 1-6, one example of a MEMS gasket for side porting is described. A MEMS microphone 100 includes a base 102 (with bottom exterior surface 103, an inner surface 107, and side exterior surface 105), a port 104 extending through the base 102, a MEMS device or transducer 106 (including a diaphragm and charge plate) disposed on the base 102, an application specific integrated circuit (ASIC) 108 disposed on the base, and pads 110 disposed on the bottom exterior surface 103 of the base 102 and that couple with the output of the ASIC 108. The microphone 100 is disposed in another device 126 such as a hearing aid, tablet, cellular phone, or personal computer. The pads 110 are electrically coupled to the ASIC 108 and the ASIC 108 is electrically couples to the MEMS device 106. A cover 109 is coupled to the base 102 and encloses the MEMS device 106 and the integrated circuit 108.

In aspects, a gasket 112 is bent around the base 102 and, more specifically around a portion of the bottom exterior surface 103 and around the side exterior surface 105 of the base 102. The gasket 112 includes a channel 114. The channel 114 communicates with the port 104 and allows sound energy 124 external to the microphone 100 to be received by the microphone 100 via the channel 114. The channel 114 has a first end 131 and a second end 132. The first end (or portion) 131 of the channel 114 communicates with the port 104 of the microphone 100, and the second end (or portion) 132 of the channel 114 is generally aligned with an edge 133 of the base 102. Acoustic energy moves through the channel 114 from the second end 132 to the first end, and then into the port 104.

A face plate 116 presses against portions of the gasket 110. The face plate 116 encloses all or some of the gasket 112 and all or some of the channel 114. The face plate 116 also aligns the microphone with a port 122 in the device a compresses the gasket 112. The gasket 112 may be constructed from a soft foam or rubber to mention two examples. Other examples of materials may also be used including materials that are not flexible. The channel 114 in the examples described herein is generally straight. However, it will be appreciated that in other examples the channel may be curved, jagged, or non-linear.

The gasket 112 may be sealed to the microphone 100 by any type of adhesive. For example, adhesive tape may be applied to the back of the gasket so it can be secured to the microphone 100. Since in some aspects the gasket 112 is constructed of a flexible or bendable material, it also can be bent around the microphone 100 in an approximately 90 degree angle. Other angles are possible. In other examples, the gasket 112 is not bent around the microphone, but is planar and generally parallel to the base 102.

The face plate 116 may be constructed out of any suitable material and may be configured in any configuration that aligns the output port of the device with the microphone 100. So configured, it will be appreciated that the microphone 100 does not have to be situated so that the port 104 is aligned with the output port of the device 126. Rather, by using the gasket 112 and the channel 114 in the gasket 112, sound energy 124 can be directed from the exterior of the device 126, through the port 122 of the device 126, through the channel 114 to the microphone port 104 and thence into the microphone 100. In other words, sound energy 124 must traverse the channel 114 before entering the microphone 100 and consequently does not directly enter the microphone 100 from the exterior of the device 126 in a direction perpendicular to the bottom surface of the microphone 100. This configuration allows a much greater flexibility in microphone design along with a much greater flexibility in the design and configuration of components within a device (e.g., a cellular phone, a hearing aid or instrument, a personal computer, or a tablet to mention a few examples).

In one aspect, the bottom surface 103 of the microphone 100 has a first dimension that is shorter than a second dimension. The channel 114 extends along portions of the second (longer) dimension. In other examples, the channel 114 may extend along the first (shorter) dimension. As mentioned, the channel 114 can assume various shapes, but in examples is generally straight. The first end (or portion) 131 of the channel 114 may align with the end of the channel 114 in some examples. In other examples, the channel 114 may extend beyond the first end (or portion) 131. The second end 132 of the channel may align or generally align with an edge (e.g., edge 133) of the base 102.

As mentioned, the face plate 116 can be constructed of any suitable material (e.g., a metal or plastic) and can be configured or arranged in a variety of different ways. The face plate 116 may be any structure that aligns the microphone 100 with an exterior port in the device 126 in which the microphone is disposed. In one aspect and as shown in the examples herein, the face plate 116 at least partially defines an acoustic channel or passageway 151 (e.g., including the channel 114) in the gasket 112 that routes sound from the exterior of the device to the microphone. In this regard, the device 126 may also include a second port 152 through which sound enters the device, traverses the acoustic passageway 151 (including the channel 114), and enters the port 104.

In one example of the operation of the system of FIG. 1, FIG. 2, FIG. 3, and FIG. 4, sound energy 124 enters the port 122 of the customer device. The sound energy traverses the passageway 151 (including the channel 114) in the direction of the arrows labeled 124. The sound energy 124 enters the microphone 100 via the port 104. The MEMS device 106 converts the sound energy into an electrical signal. The ASIC 108 processes the electrical signal. The processed electrical signal is presented at the output pads 110. Other electronic components within the customer device may further process the signal output by the ASIC 108.

So configured, a side port microphone is provided where the port of the microphone remains physically located through the base of the microphone 100. Sound energy 124 enters the microphone 100 from the side of the microphone 100 and is directed to a port 104 in the microphone 100 through the base 102. Consequently, the disposition of the microphone 100 within the customer device (e.g., a hearing aid, personal computer, tablet, or cellular phone to mention a few examples) can be much more flexible than in previous approaches where the microphone had to be arranged to take into account the configuration of the host device and the arrangement of components within the host device.

Figure 6:
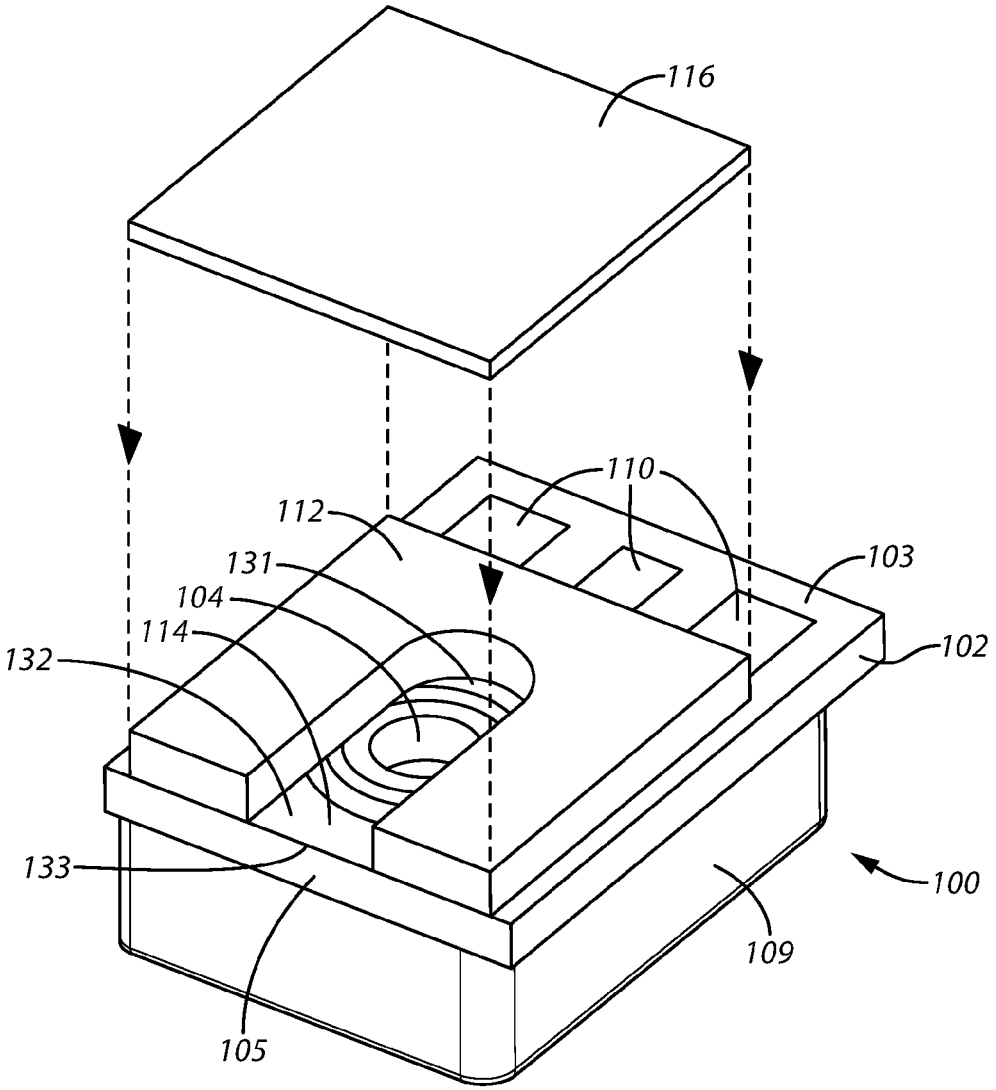
FIG. 6 comprises an exploded perspective view of an acoustic apparatus according to various embodiments of the present invention.

Referring now especially to FIG. 6, another example of an acoustic apparatus is described. In this example, the gasket 112 does not extend around the sides of the microphone 100, but is generally parallel with the base of the microphone 100. In this case, the gasket 112 need not be constructed of a flexible material since it does not need to be bent.

Preferred embodiments of this invention are described herein. It should be understood that the illustrated embodiments are exemplary only, and should not be taken as limiting the scope of the invention.

What is claimed is:

1. An apparatus, comprising:

a microphone, the microphone including a base, the base having an inner surface and an outer surface, the inner surface being generally parallel with the outer surface, the base having a port extending from the outer surface to the inner surface, the microphone including a micro electro mechanical system (MEMS) transducer coupled to the inner surface of the base over the port, the microphone having a cover coupled to the base and enclosing the MEMS transducer; and a gasket coupled to the outer surface of the base, the gasket forming a channel along the outer surface of the base, the channel having a first end and a second end, the first end communicating with the port of the microphone, and the second end of the channel being generally aligned with an edge of the base.

2. The apparatus of claim 1, wherein the channel extends completely through a thickness of the gasket.

3. The apparatus of claim 1, further comprising a plate, the plate being coupled to the gasket and covering at least some portions of the channel.

4. The apparatus of claim 3, wherein acoustic energy enters the channel at the second end, moves through the channel along the outer surface of the base of the microphone to the first end of the channel, and then passes through the port in a second direction perpendicular to a first direction.

5. The apparatus of claim 1, wherein the outer surface of the base has a first dimension and a second dimension, the first dimension is less than the second dimension and the channel extends along the first dimension.

6. The apparatus of claim 1, wherein the outer surface of the base has a first dimension and a second dimension, the first dimension is less than the second dimension and the channel extends along the second dimension.

7. The apparatus of claim 1, wherein the microphone includes an integrated circuit.

8. The apparatus of claim 1, wherein the gasket is constructed of a flexible material.

9. An apparatus, comprising:

a microphone, the microphone including a base, the base having an inner surface and an outer surface, the inner surface being generally parallel with the outer surface, the base having a port extending from the outer surface to the inner surface, the microphone including a micro electro mechanical system (MEMS) transducer coupled to the inner surface of the base over the port, the microphone having a cover coupled to the base and enclosing the MEMS transducer;

a gasket coupled to the outer surface of the base, the gasket forming a channel, the channel having a first end and a second end, the first end communicating with the port of the microphone, and the second end of the channel being generally aligned with an edge of the base, the channel extending completely through a thickness of the gasket, the channel being generally straight; and a plate, the plate being coupled to the gasket and covering at least some portions of the channel;

such that acoustic energy enters the channel at the second end, moves through the channel along the outer surface of the base of the microphone to the first end of the channel, and then passes through the port in a second direction perpendicular to a first direction.

10. The apparatus of claim 9, wherein the outer surface of the base has a first dimension and a second dimension, the first dimension is less than the second dimension and the channel extends along the first dimension.

11. The apparatus of claim 9, wherein the outer surface of the base has a first dimension and a second dimension, the first dimension is less than the second dimension and the channel extends along the second dimension.

12. The apparatus of claim 9, wherein the microphone includes an integrated circuit.

13. The apparatus of claim 9, wherein the gasket is constructed of a flexible material.

14. An electronics device, comprising:

a microphone, the microphone including a base, the base having an inner surface and an outer surface, the inner surface being generally parallel with the outer surface, the base having a port extending from the outer surface to the inner surface, the microphone including a micro electro mechanical system (MEMS) transducer coupled to the inner surface of the base over the port, the microphone having a cover coupled to the base and enclosing the MEMS transducer;

a gasket coupled to the outer surface of the base, the gasket forming a channel having an axis that intersects an axis of the port, the channel having a first end and a second end, the first end communicating with the port of the microphone, and the second end of the channel being generally aligned with an edge of the base; and a second port that communicates via a passageway with the second end of the channel.

15. The electronics device of claim 14, wherein the channel extends completely through a thickness of the gasket.

16. The electronics device of claim 15, further comprising a plate, the plate being coupled to the gasket and covering at least some portions of the channel.

17. The electronics device of claim 16, wherein acoustic energy enters the second port, enters the second end of the channel, moves through the channel along the surface of the base of the microphone to the first end of the channel, and then passes through the port in a second direction perpendicular to a first direction.

18. The electronics device of claim 14, wherein the outer surface of the base has a first dimension and a second dimension, the first dimension is less than the second dimension and the channel extends along the first dimension.

19. The electronics device of claim 14, wherein the outer surface of the base has a first dimension and a second dimension, the first dimension is less than the second dimension and the channel extends along the second dimension.

20. The electronics device of claim 14, wherein the microphone includes an integrated circuit.

* * * * *